US008433581B2

(12) United States Patent
Yoshida

(10) Patent No.: US 8,433,581 B2
(45) **Date of Patent: *Apr. 30, 2013**

(54) AUDIO ENCODING DEVICE AND AUDIO ENCODING METHOD

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 945 days.

This patent is subject to a terminal disclaimer.

(21) Appl. No.: 11/912,357

(22) PCT Filed: Apr. 27, 2006

(86) PCT No.: PCT/JP2006/308811

§ 371 (c)(1),
(2), (4) Date: Oct. 23, 2007

(87) PCT Pub. No.: WO2006/118178

PCT Pub. Date: Nov. 9, 2006

(65) Prior Publication Data

US 2009/0076809 A1 Mar. 19, 2009

(30) Foreign Application Priority Data

Apr. 28, 2005 (JP) ..... 2005-132365

(51) Int. Cl.
*G10L 19/00* (2006.01)
*G10L 21/04* (2006.01)

(52) U.S. Cl.
USPC ..... 704/500; 704/501; 704/502; 704/503; 704/504; 704/216; 704/219

(58) Field of Classification Search ..... 704/500, 704/502, 503, 504, 216, 219; 381/23.1, 17; 700/94
See application file for complete search history.

(56) References Cited

U.S. PATENT DOCUMENTS 5,274,740 A * 12/1993 Davis et al. ..... 704/203
5,285,498 A 2/1994 Johnston (Continued)

FOREIGN PATENT DOCUMENTS

JP 6-075590 3/1994
JP 10-105193 4/1998

(Continued)

OTHER PUBLICATIONS

ISO/IEC 14496-3, "Information Technology-Coding o fAudio-Visual Obj ects-Part 3: Audio," pp. 304-305 (Section 4.B. 14:Scalable AAC with core coder), Dec. 2001.*

(Continued)

*Primary Examiner* — Edgar Guerra-Erazo
(74) *Attorney, Agent, or Firm* — Greenblum & Bernstein, P.L.C.

(57) ABSTRACT

There is provided an audio encoding device capable of effectively encoding stereo audio in audio encoding having monaural-stereo scalable configuration. In this device, a correlation degree comparison unit (304) calculates correlation in a first channel (correlation degree between the past signal and the current signal in the first channel) from the first channel audio signal and calculates correlation in a second channel (correlation degree between the past signal and the current signal in the second channel) from the second channel audio signal. The correlation in the first channel is compared to the correlation in the second channel. A channel having the greater correlation is selected. According to the selection result of a correlation comparison unit (304), a selection unit (305) selects the first channel prediction signal outputted from a first channel prediction unit (307) or the first channel prediction signal outputted from a first channel signal generation unit (311) and outputs the selected signal to a subtractor (303) and a first channel prediction residual signal encoding unit (308).

5 Claims, 7 Drawing Sheets

U.S. PATENT DOCUMENTS

| | | | | |
|---|---|---|---|---|
| 5,434,948 | A | 7/1995 | Holt et al. | |
| 5,481,614 | A | 1/1996 | Johnston | |
| 5,924,062 | A * | 7/1999 | Maung | 704/219 |
| 6,122,338 | A | 9/2000 | Yamauchi | |
| 6,356,211 | B1 | 3/2002 | Shimoyoshi et al. | |
| 6,360,200 | B1 * | 3/2002 | Edler et al. | 704/219 |
| 6,393,392 | B1 * | 5/2002 | Minde | 704/220 |
| 6,529,604 | B1 | 3/2003 | Park et al. | |
| 6,539,357 | B1 | 3/2003 | Sinha | |
| 6,629,078 | B1 * | 9/2003 | Grill et al. | 704/500 |
| 6,741,965 | B1 | 5/2004 | Shimoyoshi et al. | |
| 6,961,432 | B1 | 11/2005 | Sinha et al. | |
| 7,277,849 | B2 * | 10/2007 | Streich et al. | 704/229 |
| 7,283,957 | B2 * | 10/2007 | Minde et al. | 704/229 |
| 7,392,195 | B2 * | 6/2008 | Fejzo | 704/500 |
| 7,742,912 | B2 * | 6/2010 | Den Brinker | 704/200.1 |
| 7,835,917 | B2 * | 11/2010 | Liebchen | 704/500 |
| 7,904,292 | B2 * | 3/2011 | Goto et al. | 704/219 |
| 8,078,475 | B2 * | 12/2011 | Tsushima | 704/500 |
| 2002/0154041 | A1 | 10/2002 | Suzuki et al. | |
| 2003/0014136 | A1 * | 1/2003 | Wang et al. | 700/94 |
| 2003/0191635 | A1 | 10/2003 | Minde et al. | |
| 2003/0231799 | A1 * | 12/2003 | Schmidt | 382/244 |
| 2004/0109471 | A1 * | 6/2004 | Minde et al. | 370/465 |
| 2005/0216262 | A1 * | 9/2005 | Fejzo | 704/217 |
| 2008/0215317 | A1 * | 9/2008 | Fejzo | 704/217 |
| 2009/0028240 | A1 * | 1/2009 | Huang et al. | 375/240.12 |
| 2010/0023575 | A1 * | 1/2010 | Choo et al. | 708/607 |
| 2010/0153118 | A1 * | 6/2010 | Hotho et al. | 704/500 |

FOREIGN PATENT DOCUMENTS

| | | |
|---|---|---|
| JP | 11-032399 | 2/1999 |
| JP | 11-317672 | 11/1999 |
| JP | 2001-209399 | 8/2001 |
| JP | 2001-255892 | 9/2001 |
| JP | 2002-244698 | 8/2003 |
| WO | 98/46045 | 10/1998 |
| WO | 02/23529 | 3/2002 |

OTHER PUBLICATIONS

SO/IEC 14496-3, "Information Technology-Coding of Audio-Visual Objects-Part 3: Audio," pp. 304-305 (Section 4.B. 14:Scalable AAC with core coder), Dec. 2001.*

Liebchen, T. "Improved Forward-Adaptive Prediction for MPEG-4 Audio Lossless Coding", Audio Engineering Society Convention Paper, May 2005, Barcelona.*

Ramprashad, S.A.; , "Stereophonic CELP coding using cross channel prediction," Speech Coding, 2000. Proceedings. 2000 IEEE Workshop on , vol., No., pp. 136-138, 2000.*

Hans, M.; et al. "Lossless Compression of Digital Audio." IEEE Signal Processing Magazine, vol. 18, No. 4. pp. 21-32 (Jul. 2001).*

Fejzo, Zoran; Kramer, Lorr; McDowell, Keith; Yee, Dilbert: "DTS-HD: Technical Overview of Lossless Mode of Operation", 118th AES Convention, May 28, 2005.*

Ramprashad, "Stereophonic CELP coding using cross channel prediction," Proc. IEEE Workshop on Speech Coding, pp. 136-138, Sep. 2000.

U.S. Appl. No. 11/912,522, to Yoshida, which was filed on Oct. 25, 2007.

Liebchen, "Lossless Audio Coding Using Adaptive Multichannel Prediction", Internet Citation, Oct. 5, 2002, XP-002466533, Retrieved from the Internet: URL: http://www.nue.tu-berlin.de/publications/papers/aes113.pdf.

* cited by examiner

AUDIO ENCODING DEVICE AND AUDIO ENCODING METHOD

TECHNICAL FIELD

The present invention relates to a speech coding apparatus and a speech coding method. More particularly, the present invention relates to a speech coding apparatus and a speech coding method for stereo speech.

BACKGROUND ART

As broadband transmission in mobile communication and IP communication has become the norm and services in such communications have diversified, high sound quality of and higher-fidelity speech communication is demanded. For example, from now on, hands free speech communication in a video telephone service, speech communication in video conferencing, multi-point speech communication where a number of callers hold a conversation simultaneously at a number of different locations and speech communication capable of transmitting the background sound without losing high-fidelity will be expected to be demanded. In this case, it is preferred to implement speech communication by stereo speech which has higher-fidelity than using a monaural signal, is capable of recognizing positions where a number of callers are talking. To implement speech communication using a stereo signal, stereo speech encoding is essential.

Further, to implement traffic control and multicast communication in speech data communication over an IP network, speech encoding employing a scalable configuration is preferred. A scalable configuration includes a configuration capable of decoding speech data even from partial encoded data at the receiving side.

As a result, even when encoding and transmitting stereo speech, it is preferable to implement encoding employing a monaural-stereo scalable configuration where it is possible to select decoding a stereo signal and decoding a monaural signal using part of encoded data at the receiving side.

Speech coding methods employing a monaural-stereo scalable configuration include, for example, predicting signals between channels (abbreviated appropriately as "ch") (predicting a second channel signal from a first channel signal or predicting the first channel signal from the second channel signal) using pitch prediction between channels, that is, performing encoding utilizing correlation between two channels (see Non-Patent Document 1).

Non-patent document 1: Ramprashad, S. A. , "Stereophonic CELP coding using cross channel prediction", Proc. IEEE Workshop on Speech Coding, pp. 136-138, Sep. 2000.

DISCLOSURE OF THE INVENTION

Problems to be Solved by the Invention

In the speech encoding method disclosed in non-patent document 1, in the event that correlation between both channels is low, inter-channel prediction performance (prediction gain) falls, and encoding efficiency deteriorates.

Further, when coding using inter-channel prediction is employed in stereo enhancement layer coding in a speech encoding method of a monaural-stereo scalable configuration, if correlation between channels is low and intra-channel correlation of the channels of the encoding in a stereo enhancement layer (i.e. correlation between a past signal and a current signal in a channel) becomes low, a sufficient prediction performance (prediction gain) cannot be obtained with just prediction between channels and coding efficiency therefore deteriorates.

It is therefore an object of the present invention to provide speech coding apparatus and a speech coding method that enables efficient stereo speech coding, in speech coding of a monaural-stereo scalable configuration.

Means for Resolving the Problems

Speech coding apparatus of the present invention adopt a configuration having: a first coding section that carries out core layer coding for a monaural signal; and a second coding section that carries out enhancement layer coding for a stereo signal, and, in this configuration, the first coding section generates a monaural signal from a first channel signal and a second channel signal constituting a stereo signal, and the second coding section carries out coding of the first channel using a prediction signal generated by an intra-channel prediction of one of the first channel and the second channel having the greater intra-channel correlation.

Advantageous Effect of the Invention

The present invention enables efficient stereo speech coding.

DETAILED DESCRIPTION OF THE DRAWINGS

BEST MODE FOR CARRYING OUT THE INVENTION

Speech coding employing a monaural-stereo scalable configuration according to the embodiments of the present invention will be described in detail with reference to the accompanying drawings.

(Embodiment 1)

Figure 1:
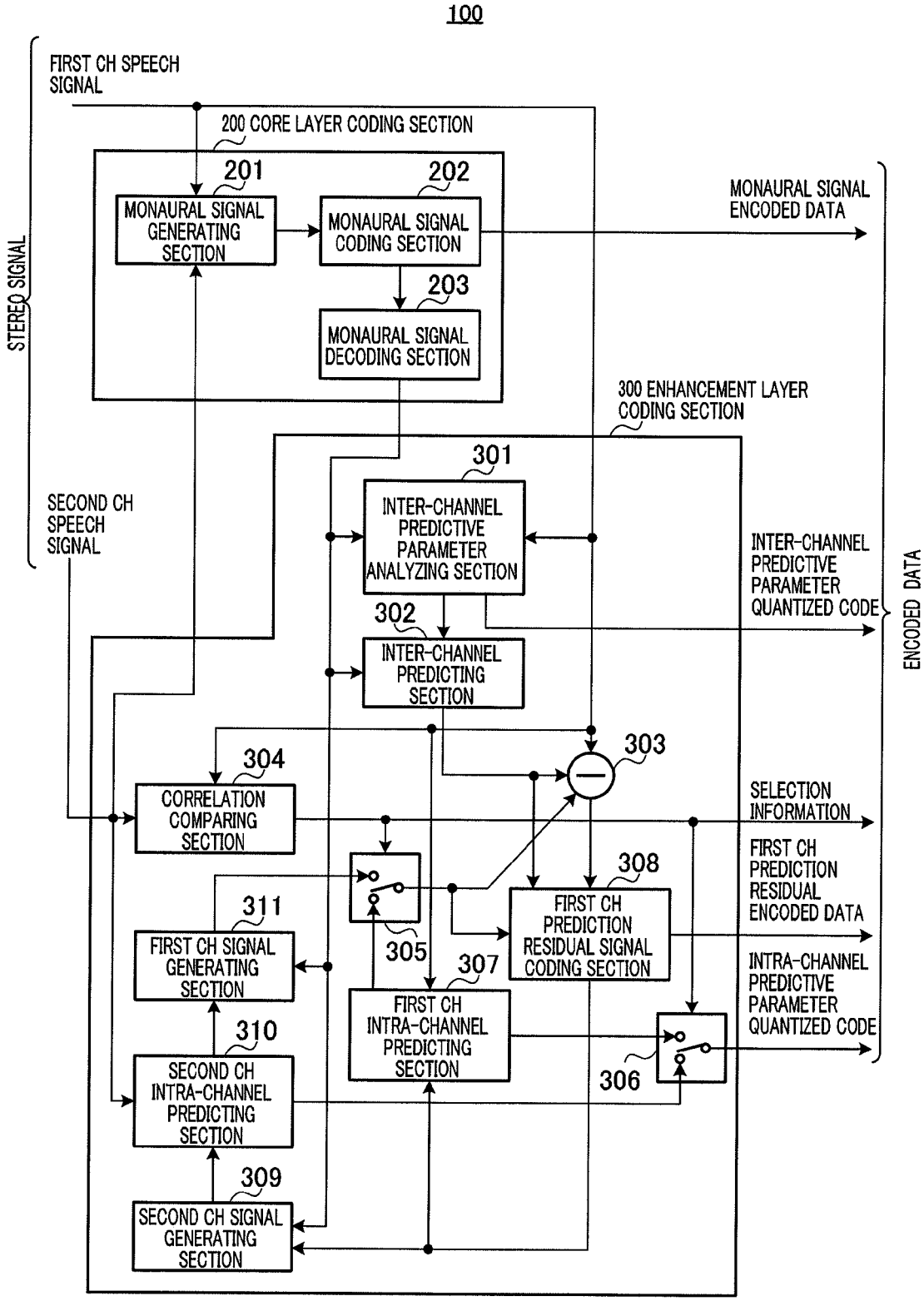
FIG. 1 is a block view showing a configuration of speech coding apparatus according to Embodiment 1 of the present invention.

FIG. 1 shows a configuration of a speech coding apparatus according to the present embodiment. Speech coding apparatus 100 shown in FIG. 1 has core layer coding section 200 for monaural signals and enhancement layer coding section 300 for stereo signals. In the following description, a description will be given assuming operation in frame units.

In core layer coding section 200, monaural signal generating section 201 generates and outputs a monaural signal s_mono (n) from an inputted first ch speech signal s_ch1(n) and an inputted second ch speech signal s_ch2(n) (where n is 0 to NF-1 and NF is the frame length) in accordance with equation 1 to monaural signal coding section 112.

[1]

$$s_mono(n)=(s_ch1(n)+s_ch2(n))/2 \quad \text{(Equation 1)}$$

Monaural signal coding section 202 encodes the monaural signal s_mono(n) and outputs encoded data of the monaural signal, to monaural signal decoding section 203. Further, the monaural signal encoded data is multiplexed with quantized code, encoded data and selection information outputted from enhancement layer coding section 300, and the result is transmitted to the speech decoding apparatus as encoded data.

Monaural signal decoding section 203 generates a decoded monaural signal from encoded data of the monaural signal, and outputs the generated decoded monaural signal to enhancement layer coding section 300.

In enhancement layer coding section 300, inter-channel predictive parameter analyzing section 301 finds and quantizes predictive parameters for a prediction of the first ch speech signal from the monaural signal (inter-channel predictive parameters) by using the first ah speech signal and the monaural decoded signal, and outputs the result to inter-channel predicting section 302. Inter-channel predictive parameter analyzing section 301 obtains a delay difference (D sample) and amplitude ratio (g) between the first ch speech signal and the monaural signal (monaural decoded signal) as inter-channel predictive parameters. Further, inter-channel predictive parameter analyzing section 301 then outputs inter-channel predictive parameter quantized code that is obtained by quantizing and encoding inter-channel predictive parameters. The inter-channel predictive parameter quantized code is then multiplexed with other quantized code, encoded data and selection information, and the result is transmitted to speech decoding apparatus (described later) as encoded data.

Inter-channel predicting section 302 predicts the first ch signal from the monaural decoded signal using quantized inter-channel predictive parameters, and outputs this first ch prediction signal (inter-channel prediction) to subtractor 303 and first ch prediction residual signal coding section 308. For example, inter-channel predicting section 302 synthesizes a first ch prediction signal sp_ch1(n) from monaural decoded signal sd_mono (n) using the prediction shown in equation 2.

[2]

$$sp_ch1(n)=g\cdot sd_mono(n-D) \quad \text{(Equation 2)}$$

Correlation comparing section 304 calculates intra-channel correlation of a first ch (correlation of a past signal and the current signal in the first ch) from the first ch speech signal, and calculates intra-channel correlation of the second ch from the second ch speech signal (correlation between a past signal and the current signal in the second ch). For example, the normalized maximum autocorrelation coefficient with respect to the corresponding speech signal, the pitch prediction gain value for the corresponding speech signal, the normalized maximum autocorrelation coefficient with respect to an LPC prediction residual signal obtained from the corresponding speech signal, or the pitch prediction gain value for an LPC prediction residual signal obtained from the corresponding speech signal etc. may be used as intra-channel correlation of each channel. Correlation comparing section 304 compares first ch intra-channel correlation and second ch intra-channel correlation, and selects the channel having the greater correlation. Selection information showing the result of this selection is then outputted to selecting sections 305 and 306. Further, this selection information is multiplexed with quantized code and encoded data, and the result is transmitted to speech decoding apparatus (described later) as encoded data.

First ch intra-channel predicting section 307 predicts the first ch signal using intra-channel prediction in the first ch from the first ch speech signal and the first ch decoded signal inputted from first ch prediction residual signal coding section 308 and outputs this first ch prediction signal to selecting section 305. Further, first ch intra-channel predicting section 307 outputs inter-channel predictive parameter quantized code of the first ch obtained by quantization of intra-channel predictive parameters required in intra-channel prediction for the first ch. The details of this intra-channel prediction will be described later.

Second ch signal generating section 309 generates a second ch decoded signal, based on the relationship of the above equation 1, from a monaural decoded signal inputted by monaural signal decoding section 203 and first ch decoding signal inputted by first ch prediction residual signal coding section 308. That is to say, second ch signal generating section 309 generates second ch decoded signal sd_ch2(n) in accordance with equation 3 from monaural decoded signal sd_mono(n) and first ch decoded signal sd_ch1(n), and outputs the result to second ch intra-channel predicting section 310.

[3]

$$sd_ch2(n)=2\cdot sd_mono(n)-sd_ch1(n) \quad \text{(Equation 3)}$$

Second ch intra-channel predicting section 310 predicts a second ch signal, using intra-channel prediction in the second ch, from the second ch speech signal and the second ch decoded signal, and outputs this second ch prediction signal to first ch signal generating section 311. Further, second ch intra-channel predicting section 310 outputs intra-channel predictive parameter quantized code for the second ch obtained by quantization of intra-channel predictive parameters required in intra-channel prediction in the second ch to selecting section 306. The details of this intra-channel prediction will be described later.

First ch signal generating section 311 generates the first ch prediction signal based on the relationship of the above equation 1 from the second ch prediction signal and monaural decoded signal inputted from monaural signal decoding section 203. Namely, first ch signal generating section 311 generates first ch prediction signal s_ch1_p(n) in accordance with equation 4 from monaural decoded signal sd_mono(n) and second ch prediction signal s_ch2_p(n), and outputs the result to selecting section 305.

[4]

$$s_ch1_p(n)=2\cdot sd_mono(n)-s_ch2_p(n) \quad \text{(Equation 4)}$$

Selecting section 305 selects one of the first ch prediction signal outputted from first ch intra-channel predicting section 307 and the first ch prediction signal outputted from first ch signal generating section 311, in accordance with the selection result at correlation comparing section 304, and outputs this to subtractor 303 and first ch prediction residual signal coding section 308. Selecting section 305 selects the first ch prediction signal outputted from first ch intra-channel predicting section 307 when the first ch is selected by correlation comparing section 304 (namely, when the intra-channel correlation of the first ch is greater than the intra-channel correlation of the second ch). On the other hand, selecting section 305 selects the first ch prediction signal outputted from first ch signal generating section 311 when the second ch is selected by correlation comparing section 304 (namely, when the intra-channel correlation of the first ch is equal to or less than the intra-channel correlation of the second ch).

Selecting section 306 selects one of the intra-channel predictive parameter quantized code for the first ch outputted from first ch intra-channel predicting section 307 and the intra-channel predictive parameter quantized code for the second ch outputted from second ch intra-channel predicting section 310, and outputs this as intra-channel predictive parameter quantized code. Intra-channel predictive parameter quantized code is then multiplexed with other quantized code, encoded data and selection information, and the result is transmitted to speech decoding apparatus (described later) as encoded data.

Specifically, when the first ch is selected by correlation comparing section 304 (i.e. when the intra-channel correlation of the first ch is greater than the intra-channel correlation of the second ch), selecting section 306 selects the intra-channel predictive parameter quantized code for the first ch outputted from first ch intra-channel predicting section 307. On the other hand, when the second ch is selected by correlation comparing section 304 (i.e. when the intra-channel correlation of the first ch is equal to or less than the intra-channel correlation of the second ch), selecting section 306 selects the intra-channel predictive parameter quantized code for the second ch outputted from second ch intra-channel predicting section 310.

Subtractor 303 finds the residual signal (first ch prediction residual signal) of the first ch speech signal of the input signal and the first ch prediction signal, that is, the remainder of subtracting the first ch prediction signal outputted from inter-channel predicting section 302 and the first ch prediction signal outputted from selecting section 305 from the first ch speech signal, and outputs this residual signal to first ch prediction residual signal coding section 308.

First ch prediction residual signal coding section 308 outputs first ch prediction residual encoded data that is obtained by encoding the first ch prediction residual signal. This first ch prediction residual encoded data is multiplexed with other encoded data, quantized code and selection information, and the result is transmitted to speech decoding apparatus (described later) as encoded data. Further, first ch prediction residual signal coding section 308 adds a signal that is first ch prediction residual encoded data decoded, first ch prediction signal outputted from inter-channel predicting section 302, and first ch prediction signal outputted from selecting section 305, so as to obtain a first ch decoded signal, and outputs this first ch decoded signal to first ch intra-channel predicting section 307 and second ch signal generating section 309.

Here, first ch intra-channel predicting section 307 and second ch intra-channel predicting section 310 carry out intra-channel prediction for predicting signals of coding target frames from past signals utilizing correlation of signals in each channel. For example, when a one-dimensional pitch prediction filter is used, signals of each channel predicted by intra-channel prediction are represented using equation 5. Here, Sp(n) is a prediction signal for each channel, and s(n) is a decoded signal for each channel (first ch decoded signal or second ch decoded signal). Further, T and gp are lag and predictive coefficients for the one-dimensional pitch prediction filter which can be obtained from decoded signals for each channel and input signals for each channel (first ch speech signal or second ch speech signal), and constitute intra-channel predictive parameters.

[5]

$$Sp(n)=gp\cdot s(n-T) \quad \text{(Equation 5)}$$

Figure 2:
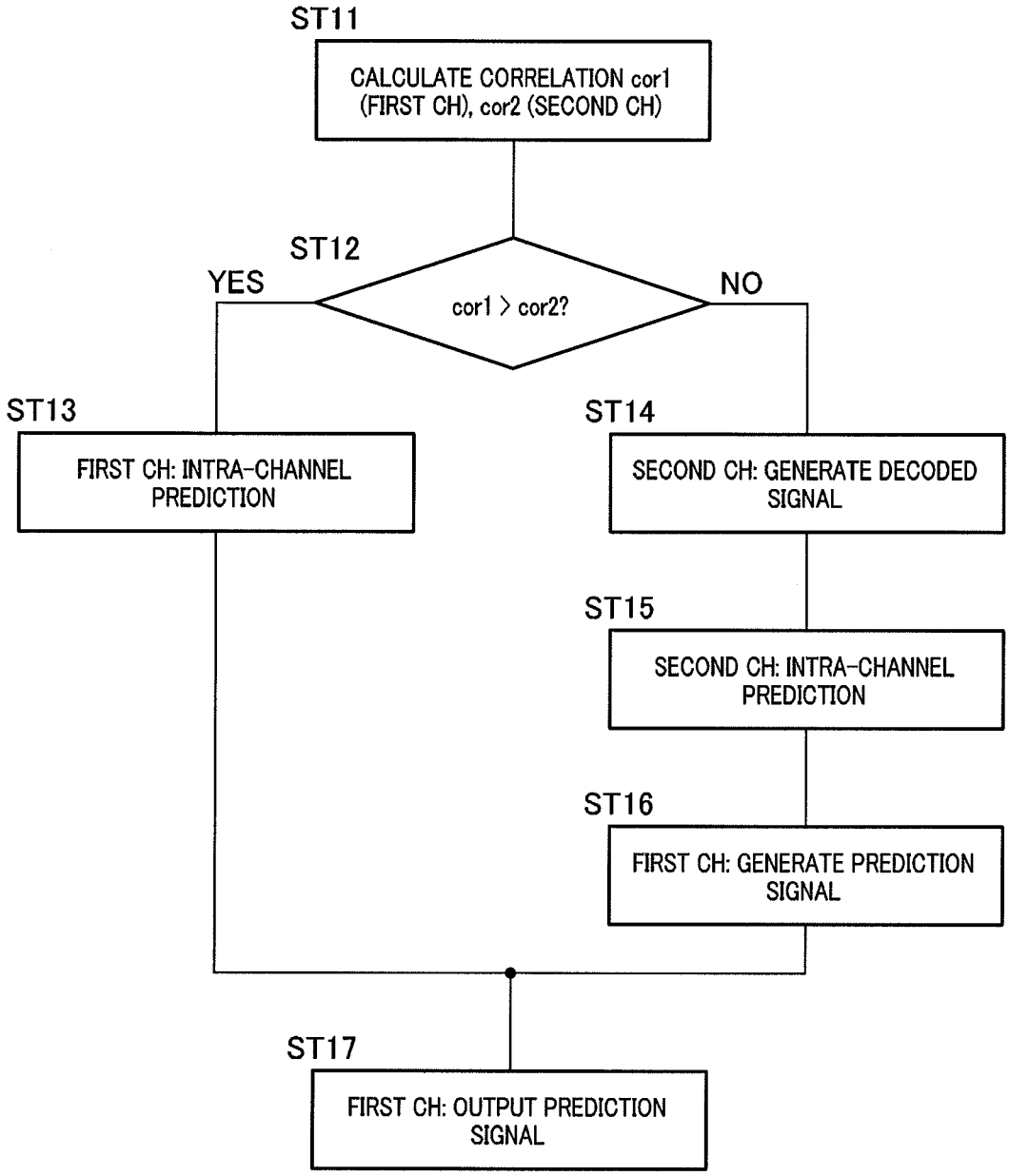
FIG. 2 is a flowchart of the operation of an enhancement layer coding section according to Embodiment 1 of the present invention.
Figure 3:
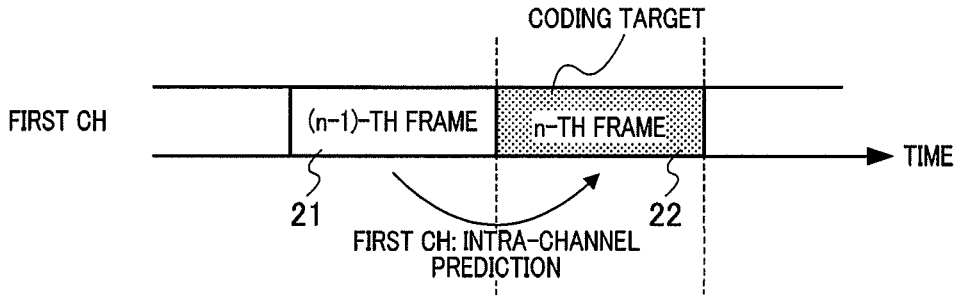
FIG. 3 is a conceptual view of the operation of an enhancement layer coding section according to Embodiment 1 of the present invention.
Figure 4:
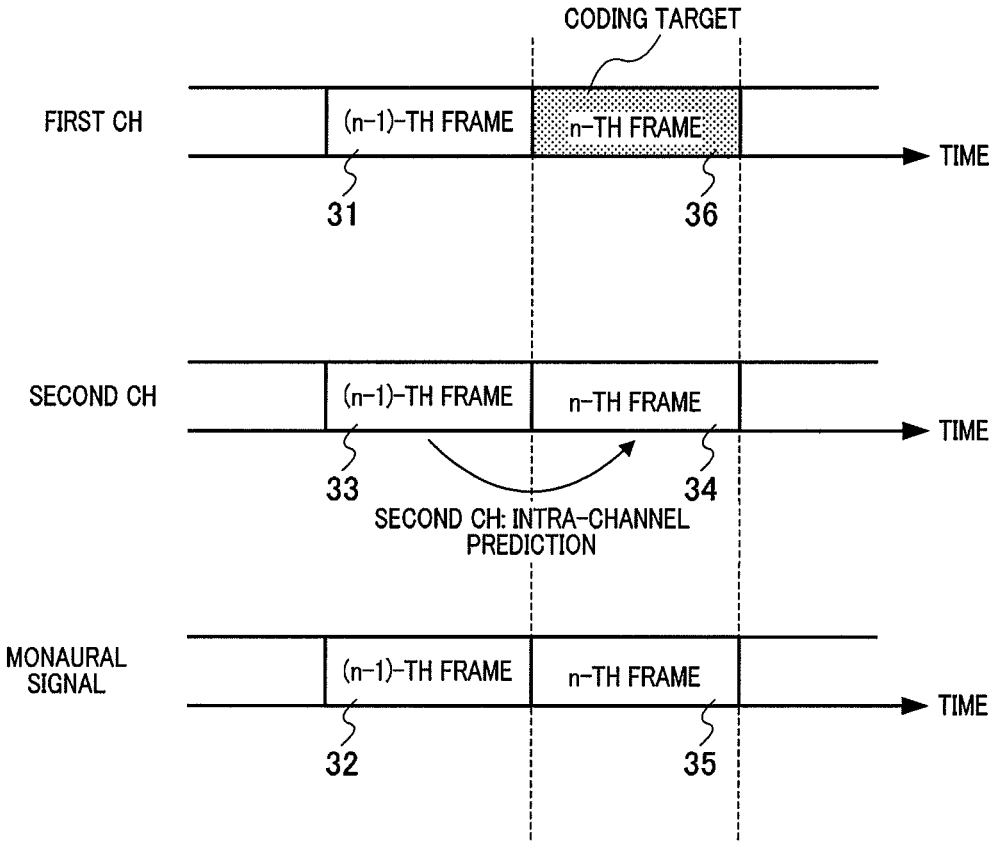
FIG. 4 is a conceptual view of the operation of an enhancement layer coding section according to Embodiment 1 of the present invention.

Next, a description is given of the operation of enhancement layer coding section 300 using FIG. 2 to FIG. 4.

First, first ch intra-channel correlation cor1 and second ch intra-channel correlation cor2 are calculated (ST11).

Next, cor1 and cor2 are compared (ST12), and the intra-channel prediction in the channel having the greater intra-channel correlation is used.

Namely, when cor1>cor2 (ST12: YES), the first ch prediction signal obtained by carrying out intra-channel prediction in the first ch is selected as a coding target. Specifically, as shown in FIG. 3, first ch signal 22 for the n-th frame is predicted in accordance with equation 5 above from first ch decoding signal 21 of the (n−1)-th frame (ST13). First ch prediction signal 22 predicted in this manner is then outputted from selecting section 305 as a coding target (ST17). Namely, when cor1>cor2, the first ch signal is predicted directly from the first ch decoded signal.

On the other hand, when cor1≦cor2 (ST12: NO), a second ch decoded signal is generated (ST14), a second channel prediction signal is found by carrying out intra-channel prediction of the second channel (ST15), and a first ch prediction signal is obtained from the second ch prediction signal and the monaural decoded signal (ST16). The first ch prediction signal obtained in this manner is then outputted from selecting section 305 as a coding target (ST17). Specifically, as shown in FIG. 4, a second ch decoded signal for the (n−1)-th frame is generated in accordance with equation 3 above from first ch decoded signal 31 for the (n−1)-th frame and monaural decoded signal 32 for the (n−1)-th frame. Next, second ch signal 34 for the n-th frame is predicted in accordance with equation 5 above from second ch decoded signal 33 of the (n−1)-th frame. Subsequently, first ch prediction signal 36 of the n-th frame is generated in accordance with equation 4 above from second ch prediction signal 34 of the n-th frame and monaural decoded signal 35 of the n-th frame. First ch prediction signal 36 predicted in this manner is then selected as a coding target. Namely, when cor1≦cor2, the first ch signal is indirectly predicted from the second ch prediction signal and the monaural decoded signal.

Figure 5:
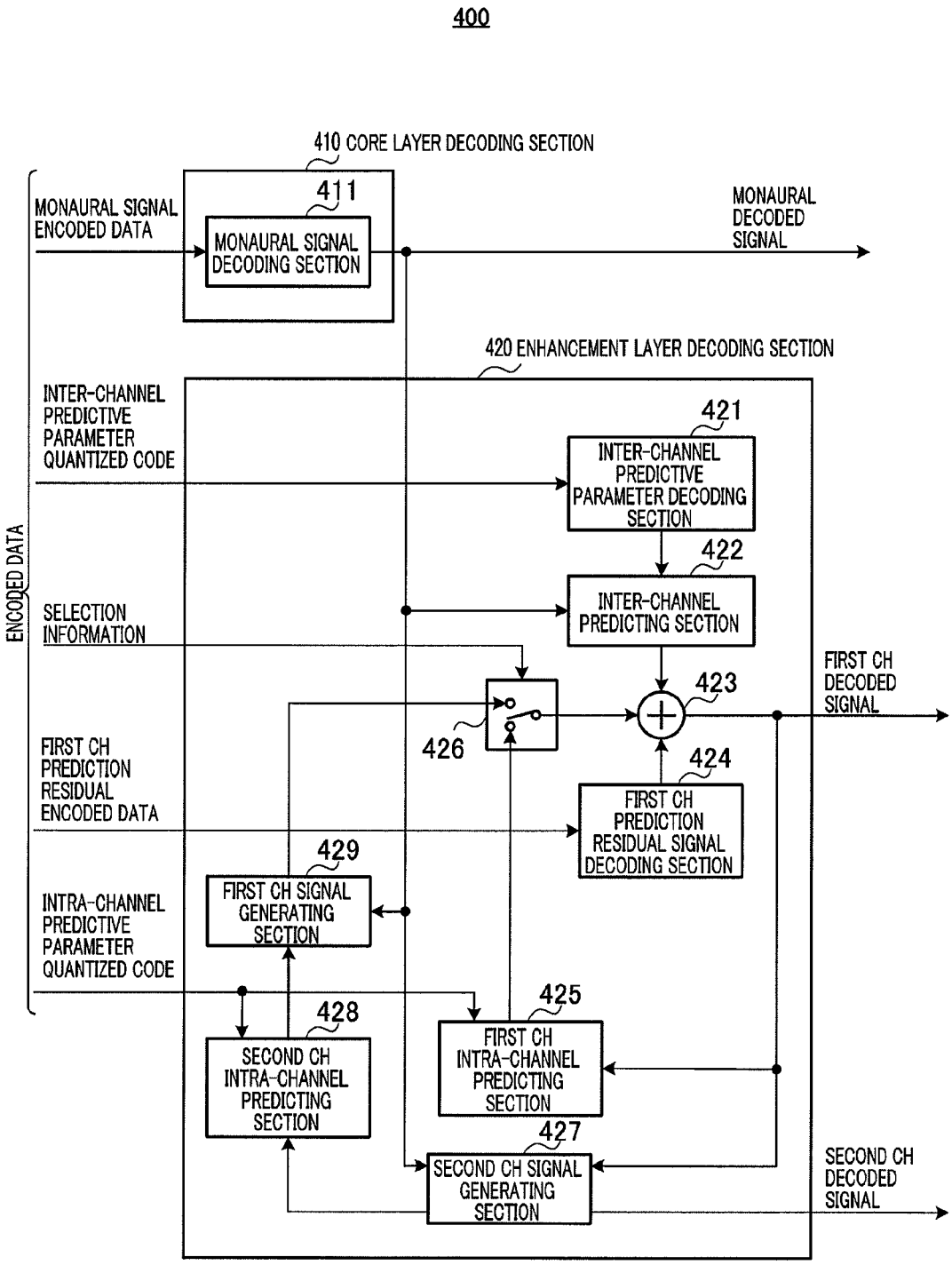
FIG. 5 is a block view showing a configuration of speech decoding apparatus according to Embodiment 1 of the present invention.

The speech decoding apparatus according to the present embodiment will be described. FIG. 5 shows a configuration of the speech decoding apparatus according to the present embodiment. Speech decoding apparatus 400 shown in FIG. 5 has core layer decoding section 410 for monaural signals and enhancement layer decoding section 420 for stereo signals.

Monaural signal decoding section 411 decodes encoded data for the input monaural signal, outputs the decoded monaural signal to enhancement layer decoding section 420 and outputs the decoded monaural signal as the actual output.

Inter-channel predictive parameter decoding section 421 decodes inputted inter-channel predictive parameter quantized code and outputs the result to inter-channel predicting section 422.

Inter-channel predicting section 422 predicts the first ch signal from the monaural decoded signal using quantized inter-channel predictive parameters, and outputs this first ch prediction signal (inter-channel prediction) to adder 423. For example, inter-channel predicting section 422 synthesizes a first ch prediction signal sp_ch1(n) from monaural decoded signal sd_mono (n) using the prediction shown in equation 2 above.

First ch prediction residual signal decoding section 424 decodes inputted first ch prediction residual encoded data and outputs the result to adder 423.

Adder 423 find the first ch decoded signal by adding the first ch prediction signal outputted from inter-channel predicting section 422, the first ch prediction residual signal outputted from first ch prediction residual signal decoding section 424, and the first ch prediction signal outputted from selecting section 426, outputs this first decoded signal to first ch intra-channel predicting section 425 and second ch signal generating section 427, and also outputs this first decoded signal as an actual output.

First ch intra-channel predicting section 425 predicts the first ch signal from the first ch decoded signal and the intra-channel predictive parameter quantized code for the first ch, through the same intra-channel prediction as described above, and outputs this first ch prediction signal to selecting section 426.

Second ch signal generating section 427 generates second ch decoded signal in accordance with equation 3 above from the monaural decoded signal and the first ch decoded signal and outputs this second ch decoded signal to second ch intra-channel predicting section 428.

Second channel intra-channel predicting section 428 predicts the second ch signal from the intra-channel prediction from the second ch decoded signal and the intra-channel predictive parameter quantized code for the second ch as described above, and outputs this second ch prediction signal to first ch signal generating section 429.

First ch signal generating section 429 generates a first ch prediction signal in accordance with equation 4 above from the monaural decoded signal and the second ch prediction signal, and outputs this first ch prediction signal to selecting section 426.

Selecting section 426 selects one of the first ch prediction signal outputted from first ch intra-channel predicting section 425 and the first ch prediction signal outputted from first ch signal generating section 429, in accordance with the selection result shown in the selection information, and outputs the selected signal to adder 423. Selecting section 426 selects the first ch prediction signal outputted from first ch intra-channel predicting section 425 when the first ch is selected at speech coding apparatus 100 of FIG. 1 (i.e. when the intra-channel correlation of the first ch is greater than the intra-channel correlation of the second ch), and selects the first ch prediction signal outputted from first ch signal generating section 429 when the second ch is selected at speech coding apparatus 100 (i.e. when the intra-channel correlation of the first ch is equal to or less than the intra-channel correlation of the second ch).

At speech decoding apparatus 400 adopting this kind of configuration, with a monaural-stereo scalable configuration, when outputted speech is taken to be monaural, a decoded signal obtained from only encoded data of the monaural signal is outputted as a monaural decoded signal. On the other hand, at speech decoding apparatus 400, when outputted speech is taken to be stereo, a first ch decoded signal and a second ch decoded signal are decoded and outputted using all of the received encoded data and quantized code.

In this way, with this embodiment, enhancement layer coding is carried out using a prediction signal obtained from intra-channel prediction of a channel where intra-channel correlation is greater, so that, even in cases where intra-channel correlation (intra-channel prediction performance) of a coding target frame of a coding target channel (in this embodiment, the first ch) is low and prediction cannot be effectively carried out, if intra-channel correlation of another channel (in this embodiment, the second ch) is substantial, it is possible to predict the signal of the coding target channel using a prediction signal obtained by intra-channel prediction in the other channel. Therefore, even when intra-channel correlation of the coding target channel is low, it is possible to achieve sufficient prediction performance (prediction gain), and, as a result, deterioration of coding efficiency can be prevented.

In the above description, a description is given of a configuration where inter-channel predictive parameter analyzing section 301 and inter-channel predicting section 302 are provided in enhancement layer coding section 300, but it is also possible to adopt a configuration where enhancement layer coding section 300 does not have these parts. In this case, in enhancement layer coding section 300, a monaural decoded signal outputted from core layer coding section 200 is inputted directly to subtractor 303, and subtractor 303 subtracts the monaural decoded signal and first ch prediction signal from the first ch speech signal to obtain a prediction residual signal.

Further, in the above description, one of the first ch prediction signal (direct prediction) obtained directly by intra-channel prediction in the first ch and the first ch prediction signal (indirect prediction) obtained indirectly from the second ch prediction signal obtained by intra-channel prediction in the second ch, is selected depending on the magnitude of intra-channel correlation. However, the present invention is by no means limited to this, and it is also possible to select the first ch prediction signal where intra-channel prediction error for the first ch that is the coding target channel is lower (namely, error of the first ch prediction signal with respect to the first ch speech signal that is the inputted signal). Further, it is also possible to carry out enhancement layer coding using both first ch prediction signals and select the first ch prediction signal where the resulting coding distortion is less.

(Embodiment 2)

Figure 6:
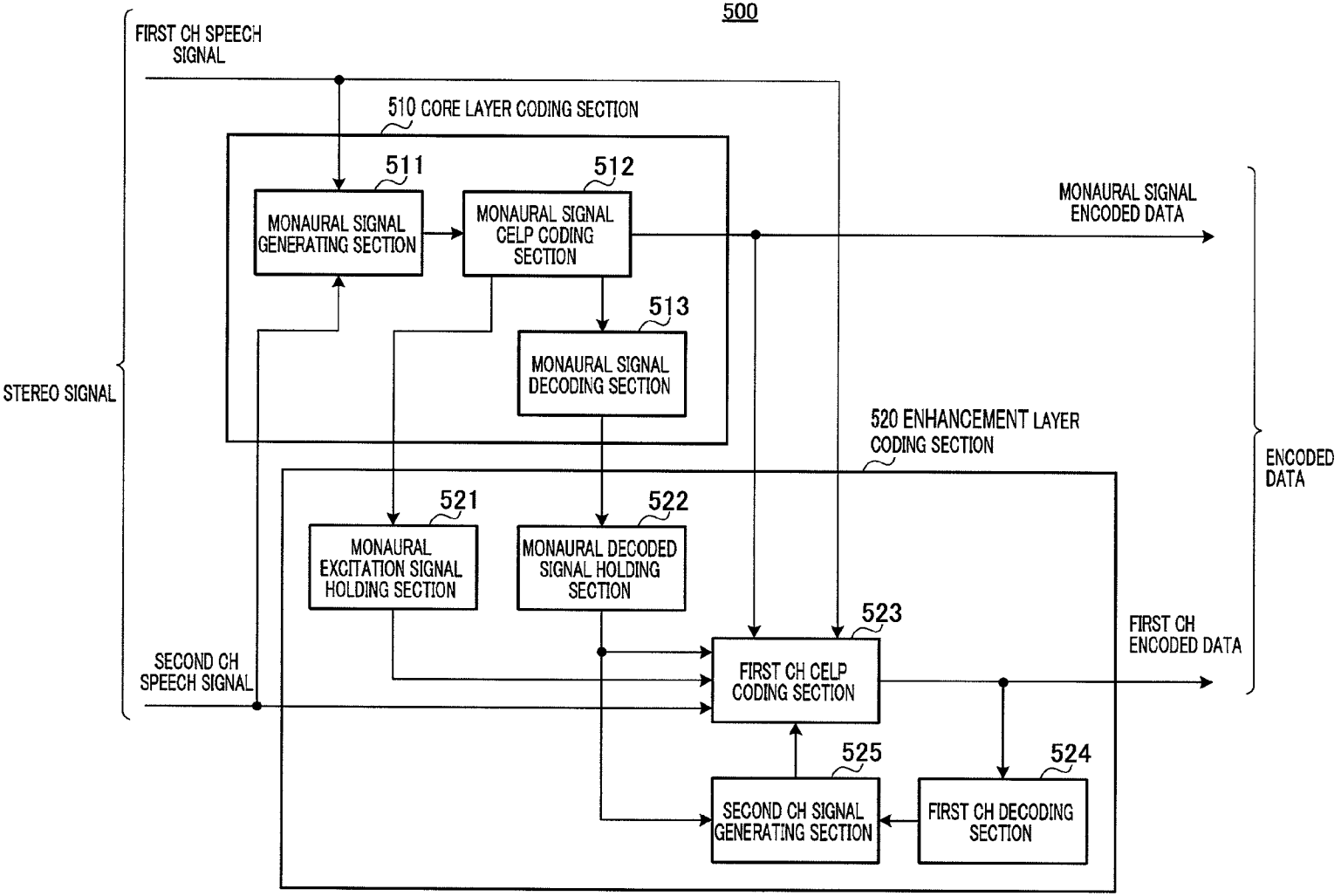
FIG. 6 is a block view showing a configuration of speech coding apparatus according to Embodiment 2 of the present invention.

FIG. 6 shows a configuration of speech coding apparatus 500 according to the present embodiment.

At core layer coding section 510, monaural signal generating section 511 generates a monaural signal in accordance with equation 1 above and outputs the result to monaural signal CELP coding section 512.

Monaural signal CELP coding section 512 subjects the monaural signal generated in monaural signal generating section 511 to CELP coding, and outputs monaural signal encoded data and monaural excitation signal obtained by CELP coding. Monaural signal encoded data is outputted to monaural signal decoding section 513, multiplexed with first ch encoded data and transmitted to the speech decoding apparatus. Further, the monaural excitation signal is held in monaural excitation signal holding section 521.

Monaural signal decoding section 513 generates a monaural decoded signal from encoded data of the monaural signal and outputs the result to monaural decoded signal holding section 522. This monaural decoded signal is held in monaural decoded signal holding section 522.

In enhancement layer coding section 520, first ch CELP coding section 523 carries out CELP coding on the first ch speech signal and outputs first ch encoded data. First ch CELP coding section 523 carries out prediction of the excitation signal corresponding to the first ch speech signal and CELP coding of this prediction residual component using the monaural signal encoded data, monaural decoded signal, monaural excitation signal, second ch speech signal, and second ch decoded signal inputted from second ch signal generating section 525. In CELP excitation coding of this prediction residual component, first ch CELP coding section 523 changes the codebook used for an adaptive codebook search (i.e. changes the channel for carrying out intra-channel prediction for use in coding) based on intra-channel correlation of each channel of the stereo signal. The details of first ch CELP coding section 523 will be described later.

First ch decoding section 524 decodes first ch encoded data so as to obtain a first ch decoded signal, and outputs this first ch decoded signal to second ch signal generating section 525.

Second ch signal generating section 525 generates a second ch decoded signal in accordance with equation 3 above from monaural decoded signal and first ch decoded signal and outputs the second ch decoded signal to first CELP coding section 523.

Next, the details of first ch CELP coding section 523 will be described. A configuration of first ch CELP coding section 523 is shown in FIG. 7.

Figure 7:
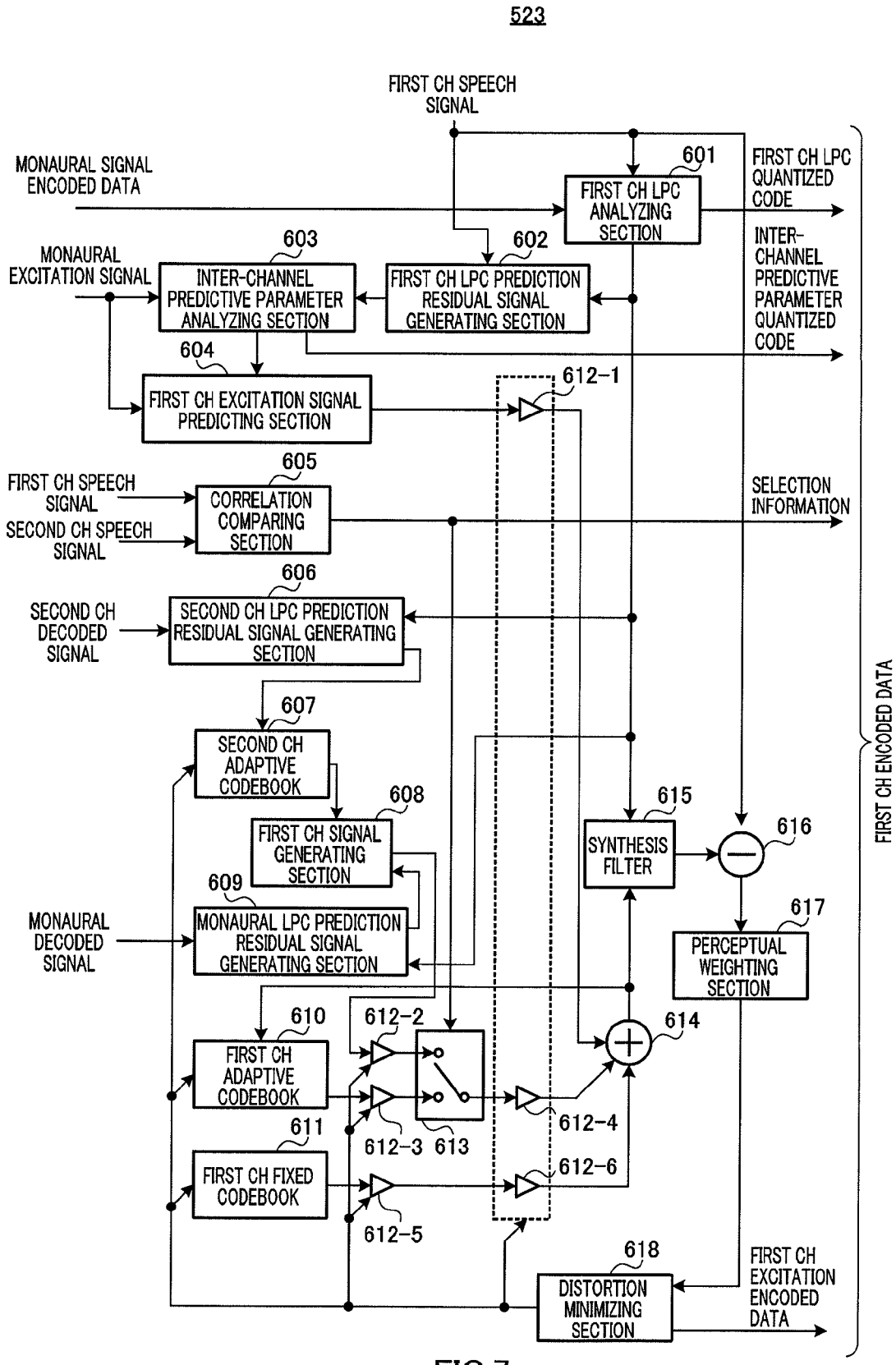
FIG. 7 is a block view showing a configuration of a first ch CELP coding section according to Embodiment 2 of the present invention.

In FIG. 7, first ch LPC analyzing section 601 subjects the first ch speech signal to LPC analysis, quantizes the obtained LPC parameters and outputs the result to first ch LPC prediction residual signal generating section 602 and synthesis filter 615, and outputs first ch LPC quantized code as first ch encoded data. Upon quantization of the LPC parameters, first ch LPC analyzing section 601 decodes monaural signal quantized LPC parameters from encoded data of the monaural signal, and performs efficient quantization by quantizing the differential components of the first ch LPC parameters with respect to this monaural signal quantized LPC parameter so as to utilize the substantial correlation of the LPC parameters for the monaural signal and the LPC parameters (first ch LPC parameters) obtained from the first ch speech signal.

First ch LPC prediction residual signal generating section 602 calculates an LPC prediction residual signal with respect to the first ch speech signal using first ch quantized LPC parameters, and outputs this signal to inter-channel predictive parameter analyzing section 603.

Inter-channel predictive parameter analyzing section 603 finds and quantizes predictive parameters for a prediction of the first ch speech signal from the monaural signal (inter-channel predictive parameters) by using the LPC prediction residual signal and the monaural excitation signal, and outputs the result to first ch excitation predicting section 604. Further, inter-channel predictive parameter analyzing section 603 then outputs inter-channel predictive parameter quantized code that is inter-channel predictive parameters quantized and encoded as first ch encoded data.

First ch excitation signal predicting section 604 synthesizes a prediction excitation signal corresponding to the first ch speech signal using a monaural excitation signal and quantized inter-channel predictive parameters. This prediction excitation signal is multiplied by the gain at multiplier 612-1 and outputted to adder 614.

Here, inter-channel predictive parameter analyzing section 603 corresponds to inter-channel predictive parameter analyzing section 301 of the Embodiment 1 (FIG. 1) and operates in the same manner. Further, first ch excitation signal predicting section 604 corresponds to inter-channel predicting section 302 according to Embodiment 1 (FIG. 1) and operates in the same manner. However, this embodiment is different from Embodiment 1 in predicting a monaural excitation signal and synthesizing a predicted excitation signal of the first ch, rather than predicting a monaural decoded signal and synthesizing a predicted first ch signal. In this embodiment, excitation signals for residual components (error components that cannot be predicted) for the prediction excitation signal are encoded by excitation search in CELP encoding.

Correlation comparing section 605 calculates intra-channel correlation of the first ch from the first ch speech signal and calculates intra-channel correlation of the second ch from the second ch speech signal. Correlation comparing section 605 compares the first ch intra-channel correlation and the second ch intra-channel correlation, and selects the channel with the greater correlation. Selection information showing the result of this selection is then outputted to selecting section 613. Further, this selection information is outputted as first ch encoded data.

Second ch LPC prediction residual signal generating section 606 generates an LPC prediction residual signal with respect to the second ch decoded signal from the first ch quantized LPC parameter and the second ch decoded signal, and generates second ch adaptive codebook 607 configured using the second ch LPC prediction residual signals up to the previous subframe (i.e. the (n−1)-th subframe).

Monaural LPC prediction residual signal generating section 609 generates an LPC prediction residual signal (monaural LPC prediction residual signal) for the monaural decoded signal from the first ch quantized LPC parameters and the monaural decoded signal and outputs the result to first ch signal generating section 608.

First ch signal generating section 608 calculates code vector Vacb_ch1(n) corresponding to the first ch adaptive excitation in accordance with equation 6 based on the relationship of equation 1 above using code vector Vacb_ch2(n) (where n is 0 to NSUB-1 and NSUB is the subframe length (i.e. the length of the CELP excitation search period)) outputted from second ch adaptive codebook 607 based on adaptive codebook lag corresponding to the index specified by distortion minimizing section 618 and monaural LPC prediction residual signal Vres_mono (n) of the current subframe (n-th subframe) of the coding target, and outputs this as an adaptive codebook vector. This code vector Vacb_ch1(n) is multiplied by the adaptive codebook gain at multiplier 612-2 and outputted to selecting section 613.

[6]

$$Vacb_ch1(n)=2\cdot Vres_mono(n)-Vacb_ch2(n) \quad \text{(Equation 6)}$$

First ch adaptive codebook 610 outputs code vectors for the first ch of one subframe portion as an adaptive codebook vector to multiplier 612-3 based on adaptive codebook lag corresponding to the index designated by distortion minimizing section 618. This adaptive codebook vector is then multiplied by the adaptive codebook gain at multiplier 612-3 and is outputted to selecting section 613.

Selecting section 613 selects one of the adaptive codebook vector outputted from multiplier 612-2 and the adaptive codebook vector outputted from multiplier 612-3 in accordance with the selection result at correlation comparing section 605, and outputs the selected vector to multiplier 612-4. Selecting section 613 selects the adaptive codebook vectors outputted from multiplier 612-3 when the first ch is selected by correlation comparator 605 (i.e. when the channel correlation of the first ch is greater than the intra-channel correlation of the second ch), and selects the adaptive codebook vectors outputted from multiplier 612-2 when the second ch is selected by correlation comparing section 605 (when the intra-channel correlation of the first ch is equal to or less than the intra-channel correlation of the second ch).

Multiplier 612-4 multiplies adaptive codebook vector outputted from selecting section 613 by another gain and outputs the result to adder 614.

First ch fixed codebook 611 outputs code vectors corresponding to an index designated by distortion minimizing section 618 to multiplier 612-5 as fixed codebook vectors.

Multiplier 612-5 multiplies the fixed codebook vector outputted from first ch fixed codebook 611 by the fixed codebook gain and outputs the result to multiplier 612-6.

Multiplier 612-6 multiplies the fixed codebook vector by another gain and outputs the result to adder 614.

Adder 614 adds a prediction excitation signal outputted from multiplier 612-1, adaptive codebook vectors outputted from multiplier 612-4, and fixed codebook vectors outputted from multiplier 612-6, and outputs excitation vectors after addition to synthesis filter 615 as an excitation.

Synthesis filter 615 carries out synthesis using an LPC synthesis filter taking the excitation vector outputted from adder 614 as excitation using first ch quantized LPC parameters, and outputs the synthesize signal obtained as a result of this synthesis to subtractor 616. The component corresponding to the first ch prediction excitation signal in the synthesized signal is equivalent to the first ch prediction signal outputted from inter-channel predicting section 302 in Embodiment 1 (FIG. 1).

Subtractor 616 then calculates an error signal by subtracting the synthesized signal outputted from synthesis filter 615 from the first ch speech signal and outputs this error signal to perceptual weighting section 617. This error signal is equivalent to coding distortion.

Perceptual weighting section 617 assigns perceptual weight to the coding distortion outputted from subtractor 616 and outputs the result to distortion minimizing section 618.

Distortion minimizing section 618 decides upon an index in such a manner that code distortion outputted from perceptual weighting section 617 becomes a minimum for second ch adaptive codebook 607, first ch adaptive codebook 610, and first ch fixed codebook 611, and designates the index used by second ch adaptive codebook 607, first ch adaptive codebook 610 and first ch fixed codebook 611. Further, distortion minimizing section 618 generates gains corresponding to these indexes (adaptive codebook gain and fixed codebook gain) and outputs these gains to multipliers 612-2, 612-3, and 612-5.

Further, distortion minimizing section 618 generates gains so as to adjust gain between three types of signals, namely the prediction excitation signal outputted from first ch excitation signal predicting section 604, the adaptive codebook vector outputted from selecting section 613, and the fixed codebook vector outputted from multiplier 612-5, and outputs these gains to multipliers 612-1, 612-4 and 612-6. The three types of gains for adjusting gain between these three types of signals are preferably generated so as to give correlation between these gain values. For example, in the event that inter-channel correlation between the first ch speech signal and the second ch speech signal is substantial, the proportion of the prediction excitation signal is comparatively large with respect to the proportion of the adaptive codebook vector for after gain multiplication and the fixed codebook vector for after gain multiplication, while, on the other hand, in the event that inter-channel correlation is low, the proportion of the prediction excitation signal is relatively low with respect to the proportion of the adaptive codebook vector for after gain multiplication and the fixed codebook vector for after gain multiplication.

Further, distortion minimizing section 618 takes these indexes, and the sign of each gain corresponding to these indexes and the sign of the gain for inter-signal adjustment use, as first ch excitation encoded data. This first ch excitation encoded data is then outputted as first ch encoded data.

Figure 8:
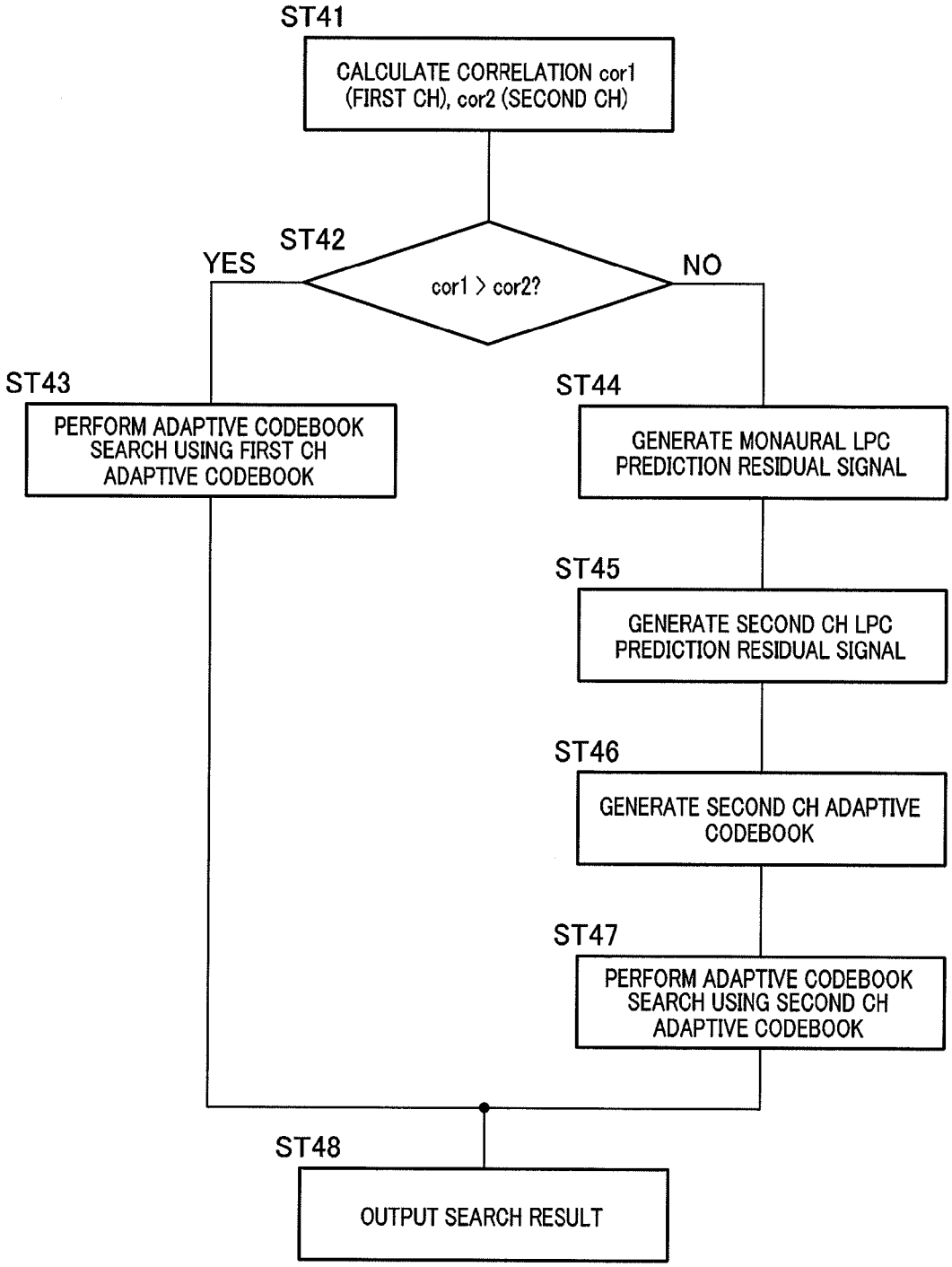
FIG. 8 is a flowchart illustrating the operation of the first ch CELP coding section according to Embodiment 2 of the present invention.

Next, a description is given of the operation of first ch CELP coding section 523 using FIG. 8.

First, first ch intra-channel correlation cor1 and second ch intra-channel correlation cor2 are calculated (ST41).

Next, cor1 and cor2 are compared (ST42), and adaptive codebook search is carried out using the adaptive codebook for the channel having the greater intra-channel correlation.

Namely, when cor1>cor2 (ST42: YES), adaptive codebook search is carried out using the first ch adaptive codebook (ST43), and the search result is outputted (ST48).

On the other hand, when cor1≦cor2 (ST42: NO), a monaural LPC prediction residual signal is generated (ST44), a second ch LPC prediction residual signal is generated (ST45), a second ch adaptive codebook is generated from a second ch LPC prediction residual signal (ST46), an adaptive codebook search is carried out using a monaural LPC prediction residual signal and a second ch adaptive codebook (ST47), and the search result is outputted (ST48).

According to this embodiment, it is possible to enable more efficient coding than in Embodiment 1 by using CELP coding which is suitable for speech coding.

In the above description, a description is given of a configuration where first ch LPC prediction residual signal generating section 602, inter-channel predictive parameter analyzing section 603 and first ch excitation signal predicting section 604 are provided in first CELP coding section 523, but it is also possible to adopt a configuration where first ch CELP coding section 523 does not have these parts. In this case, at first ch CELP coding section 523, gain is multiplied directly with the monaural excitation signal outputted from monaural excitation signal holding section 521 and the result is outputted to adder 614.

Further, in the above description, one of the adaptive codebook search using the first ch adaptive codebook 610 and the adaptive codebook search using second ch adaptive codebook 607 is selected depending on the magnitude of intra-channel correlation, but it is also possible to carry out both of these adaptive codebook searches and select the search result in which the coding distortion of the coding target channel (in this embodiment, the first ch) is less.

It is also possible for the speech coding apparatus and speech decoding apparatus of each of the above embodiments to be mounted on wireless communication apparatus such as wireless communication mobile station apparatus and wireless communication base station apparatus etc. used in a mobile communication system.

Further, a description is given in each of the above embodiments of an example of the case where the present invention is configured using hardware but the present invention may also be implemented using software.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese patent application No. 2005-132365, filed Apr. 28, 2005, the entire content of which is expressly incorporated herein by reference.

Industrial Applicability

The present invention is suitable for use in mobile communication systems and communication apparatus such as packet communication systems etc. employing internet protocols.

The invention claimed is:

1. A speech coding apparatus, comprising:

a first coder, comprising a processor, that carries out core layer coding for a monaural signal;

a second coder that carries out enhancement layer coding for a stereo signal;

a correlation comparator that calculates a first intra-channel correlation corresponding to a first single channel signal and a second intra-channel correlation corresponding to a second single channel signal, compares the first intra-channel correlation and the second intra-channel correlation, the first single channel signal and the second single channel signal constituting the stereo signal, and the correlation comparator selects a first channel of the first single channel signal if the first intra-channel correlation is greater than the second intra-channel correlation, and selects a second channel of the second single channel signal if the second intra-channel correlation is greater than the first intra-channel correlation, and an outputter that outputs encoded data so that the encoded data is transmitted to a speech decoding apparatus, wherein:

the first coder generates a monaural signal from the first channel signal and the second channel signal;

the second coder carries out coding of the first channel using a prediction signal generated by an intra-channel prediction of the channel selected by the correlation comparator; and the encoded data includes selection information representing the channel selected by the correlation comparator, data coded by the second coder and data coded by the first coder.

2. The speech coding apparatus of claim 1, wherein, when the second channel has greater channel correlation, the second coder predicts the first single channel signal from a prediction signal generated by an intra-channel prediction of the second channel and the monaural signal.

3. A wireless communication mobile station apparatus comprising the speech coding apparatus of claim 1.

4. A wireless communication base station apparatus comprising the speech coding apparatus of claim 1.

5. A speech encoding method for carrying out core layer coding for a monaural signal and enhancement layer coding for a stereo signal, the method comprising:

in the core layer, generating a monaural signal from a first single channel signal and a second single channel signal constituting a stereo signal;

in the enhancement layer, calculating a first intra-channel correlation corresponding to the first single channel signal and a second intra-channel correlation corresponding to the second single channel signal, comparing the first intra-channel correlation and the second intra-channel correlation, selecting a first channel of the first single channel signal if the first intra-channel correlation is greater than the second intra-channel correlation, and selecting a second channel of the second single channel signal if the second intra-channel correlation is greater than the first intra-channel correlation, and carrying out coding of the first channel using a prediction signal generated by an intra-channel prediction of the selected channel having greater intra-channel correlation; and outputting encoded data so that the encoded data is transmitted to a speech decoding apparatus, wherein:

the encoded data includes selection information representing the selected channel, data coded in the core layer and data coded in the enhancement layer.

* * * * *